US005533740A

United States Patent [19]

Lin

[11] Patent Number: 5,533,740

[45] Date of Patent: Jul. 9, 1996

[54] IN-LINE ROLLER SKATE

[75] Inventor: Dong-ping Lin, Taoyuan Hsien, Taiwan

[73] Assignee: Polygon Industries Corporation, Taipei, Taiwan

[21] Appl. No.: 518,813

[22] Filed: Aug. 24, 1995

[51] Int. Cl.[6] ..... A63C 17/06

[52] U.S. Cl. ..... 280/11.22; 280/11.27

[58] Field of Search ..... 280/11.19, 11.22, 280/11.23, 11.2, 11.27, 11.28, 87.041, 87.042

[56] References Cited

U.S. PATENT DOCUMENTS

| | | | |
|---|---|---|---|
| 3,756,614 | 9/1973 | Grubin | 280/11.22 |
| 4,058,324 | 11/1977 | Dallaire | 280/11.22 |
| 4,273,345 | 6/1981 | Doretal | 280/11.22 |
| 5,280,931 | 1/1994 | Horton | 280/11.22 |
| 5,484,149 | 1/1996 | Lee | 280/11.22 |

*Primary Examiner*—Richard M. Camby
*Attorney, Agent, or Firm*—Watson Cole Stevens Davis

[57] ABSTRACT

An in-line roller skate comprises a central box-like channel piece, a front bracket and a rear bracket are fixedly mated to an upper surface of the box-like channel piece. A plurality of bores are transversely defined near a bottom of the box-like channel piece and corresponding holes are defined in the front and rear brackets to align with the bores. A corresponding number of wheels, each defining a bore are rotatably engaged in-line with the combined box-like channel piece and front and rear brackets by a corresponding number of bolts extending through the front and rear brackets, the box-like channel piece and wheels. A distal tip of each bolt is threadedly engaged with a nut.

2 Claims, 3 Drawing Sheets

IN-LINE ROLLER SKATE

FIELD OF THE INVENTION

The present invention relates to roller skates and more particularly to an in-line roller skate which is convenient for disassembly and re-assembly.

BACKGROUND OF THE INVENTION

Roller skating is a popular sport for most people and a kind of roller-type skate is developed to meet the needs of entertainment without place limitation. Prior art roller-type skates provide a skate composed of a flat portion for receiving the feet of the user and a plurality of rollers arrayed in a line under the flat portion. The flat portion is made integrally so that it is not easy for selective repair or is not economical for replacement when the skates suffer from extreme vibration and are damaged on uneven terrain.

SUMMARY OF THE INVENTION

An in-line roller skate comprises a central box-like channel piece, a front bracket matingly fixed thereto, a rear bracket matingly fixed thereto, a plurality of rollers rotatingly fixed in-line to the combined box-like channel piece and the front and rear brackets by a respective plurality of bolts with a protruding tip of each bolt threadedly engaging with a corresponding nut.

By this arrangement the skate can be convenient for disassembly and reassembly, repair, and partial replacement.

DETAILED DESCRIPTION OF THE PREFERRED EMBODIMENT

Figure 1:
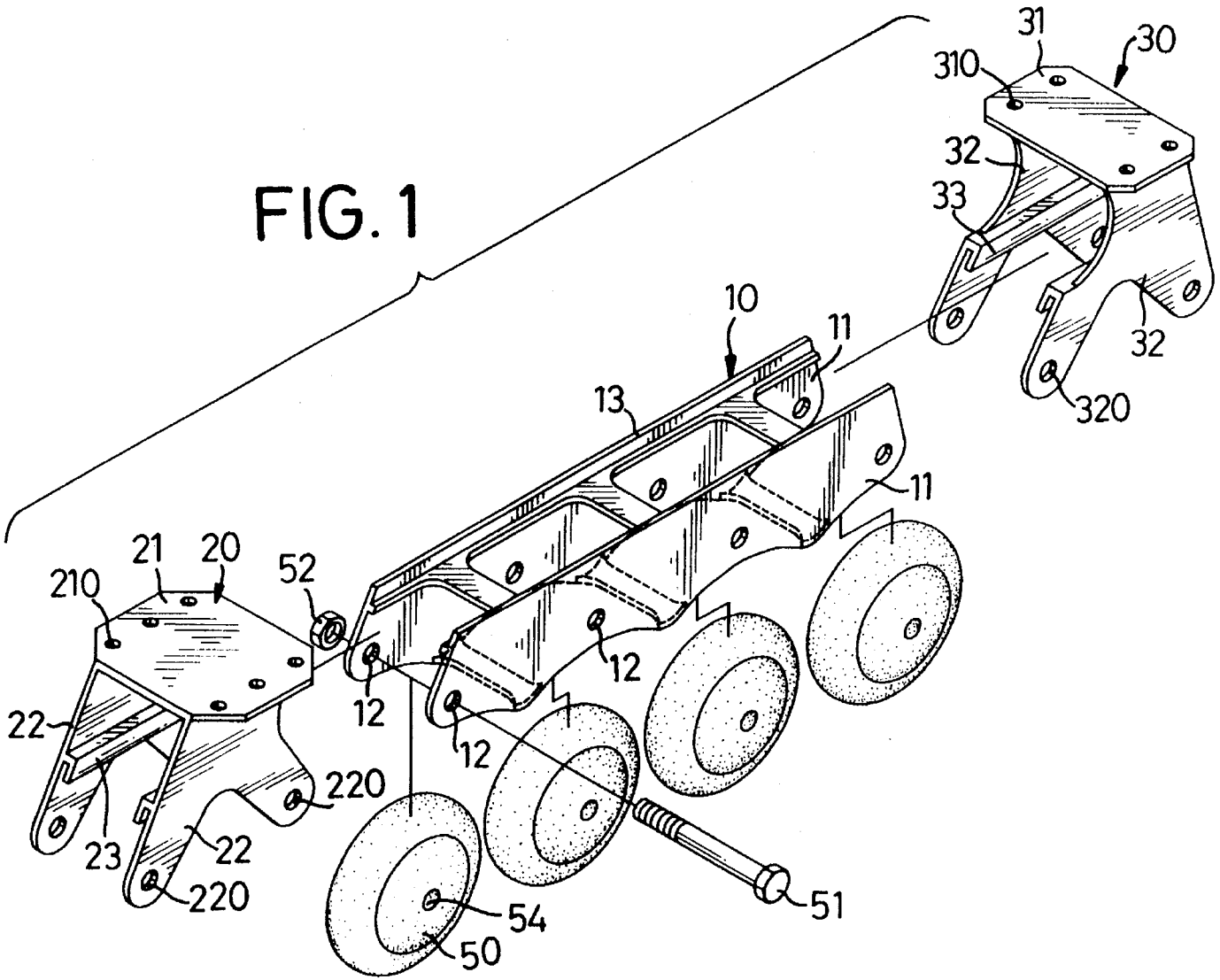
FIG. 1 is an exploded view of the present invention.

Referring to the Drawings and especially FIG. 1, the present invention is a base for an in-line roller skate which comprises a central box-like channel piece 10, a front bracket 20, a rear bracket 30, a plurality of wheels 50 and a corresponding plurality of fixing devices.

The box-like channel piece 10 has two parallel side-plates 11, an upper central portion integrally formed as spars at a top between the two sideplates 11 and a lower central portion integrally formed as spars at a bottom between the two sideplates 11.

A plurality of bores 12, for example, four, are transversely defined in each sideplate 11 near the bottom thereof. The bores 12 of each sideplate 11 are in respective alignment with the bores of the other sideplate 11 and sized to receive a bolt 51.

The box-like channel piece 10 further has two longitudinal ridges 13 extending along distal edges of a top surface of the upper central portion.

The front bracket 20 has a top plate 21 and two legs 22 extending integrally and downwardly therefrom. The legs 22 are respectively formed near opposite distal edges of the bracket 20. A bottom of each leg is formed as an inverted-v portion. A hole 220 is transversely defined through each lower tip of the inverted-v portion.

Figure 2:
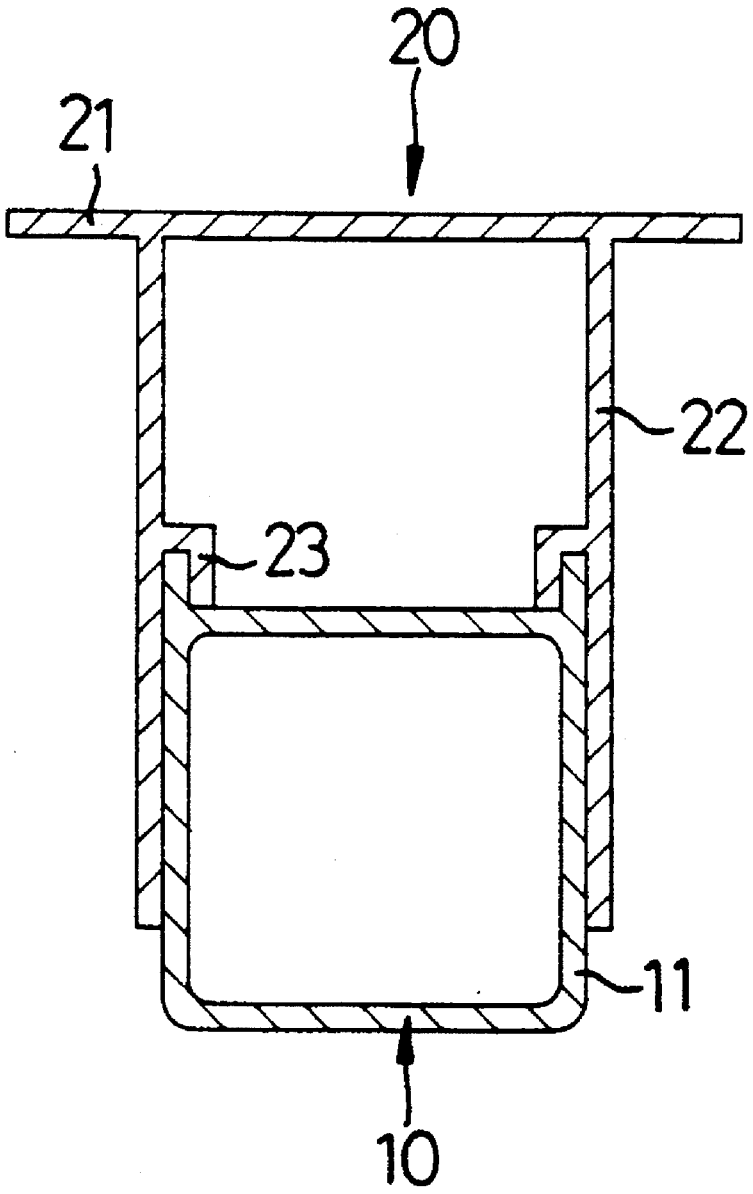
FIG. 2 is a fragmentary cross-sectional view of this invention showing mating of a box-like channel piece and a front bracket.

Referring to FIG. 2, a longitudinal hook 23 is formed on an inner surface of each inverted-v portion near a top thereof. A gap defined within the hook portion is sized to slidingly fit over a respective ridge 13 of the box-like channel piece 10. A distance between the inner face of one of the inverted-v portions and the inner face of the other inverted-v portion is nominally larger than a width of the box-like channel piece 10. Each hole 220 of the front bracket is sized and spaced to align with a respective bore 12 of the box-like channel piece 10 when the front bracket 20 is mounted thereon. The front bracket 20 further has a series of holes 210 defined vertically through the top plate 21 so that it may be fixedly attached to a sole of footwear by cord etc.

The rear bracket 30 is formed substantially the same as the front bracket 20 with numerals being prefixed with 3 rather than 2 as in the front bracket. Furthermore, the top plate 31 may have a quantity of holes 310, different to the quantity of holes 210 in the front bracket.

Figure 3:
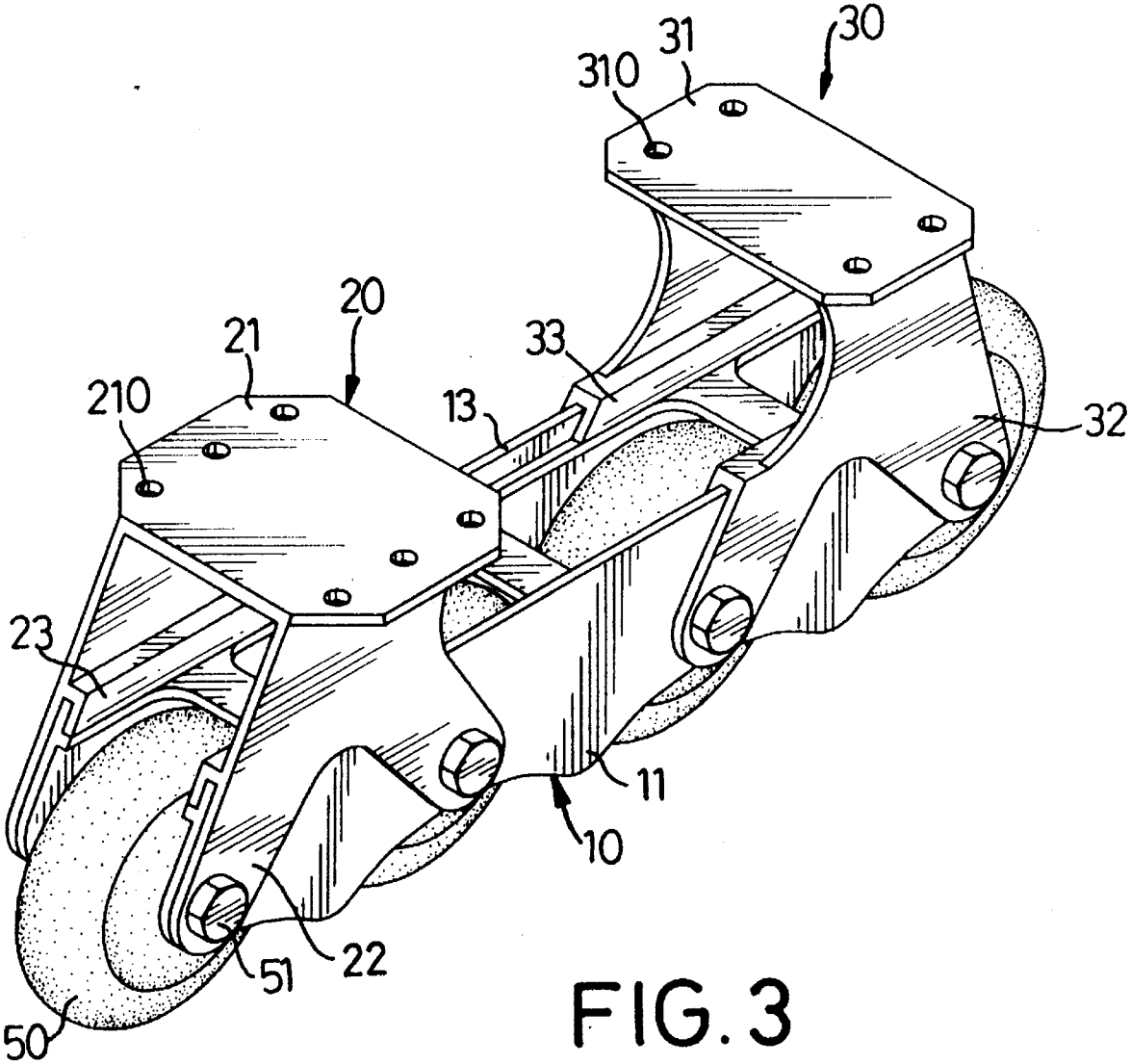
FIG. 3 is a perspective view of an assembled in-line roller skate in accordance with the present invention.

In assembly, as seen in FIG. 3, the front bracket 20 is mounted over a front end of the box-like channel piece 10 so that the ridges 13 mate with the hooks 23.

The holes 220 of each inverted-v portion respectively align with the holes 12 of the box-like channel piece. The rear bracket 30 is mounted over a rear end of the box-like channel piece in substantially an identical fashion to that of the front bracket and will not be described in further detail.

The wheels 50 are disposed in the box-like channel piece in an underside thereof and bores 54 of the wheels 50 align with respective holes 220, 320 of the front and rear brackets 20 and 30, enabling each corresponding bolt 51 to extend therethrough until a distal tip of each bolt 51 protrudes from the front and rear brackets 20 and 30. A nut 52 is threadedly engaged to each bolt 51 at the distal tip thereof to fasten together the wheels 50, box-like channel piece 10, and front and rear brackets 20 and 30.

Although the present invention has been explained in relation to its preferred embodiment, it is to be understood that many other possible modifications and variations can be made without departing from the spirit and scope of the invention as hereinafter claimed.

What the invention claimed is:

1. An in-line roller skate comprising:

a box-like channel piece with two sideplates, said sideplates having a plurality of transverse holes defined therethrough;

a plurality of wheels each with a bore therethrough rotatably disposed in-line between said sideplates;

a front bracket and a rear bracket each having a flat portion for fixing to footwear and two legs extending downwardly therefrom for slidingly mounting to the box-like channel piece, each leg defining a plurality of holes; and a plurality of securing elements extending through respective holes of the front bracket and the rear bracket, the holes in the sideplates and the bores of the wheels in turn to affix the front bracket and rear bracket and the wheels to the box-like channel piece.

2. An in-line skate as claimed in claim 1, wherein:

the box-like channel piece has two longitudinal ridges extending upwardly therefrom at distal edges thereof; and the front bracket and the rear bracket each comprise a longitudinal hook defined on each inner face thereof to matingly engage with a corresponding ridge.

* * * * *